US005142839A

United States Patent [19]

Kraemer

[11] Patent Number: 5,142,839

[45] Date of Patent: Sep. 1, 1992

[54] METHOD FOR CONSTRUCTION OF REFRACTORY LINING FOR FURNACE

[76] Inventor: Robert P. Kraemer, P.O. Box 305, Pitman, N.J. 08071

[21] Appl. No.: 694,576

[22] Filed: May 2, 1991

[51] Int. Cl.[5] ..... E04B 1/35; E04B 5/04

[52] U.S. Cl. ..... 52/741; 52/596; 52/600; 52/510; 52/512; 110/336

[58] Field of Search ..... 52/596, 600, 612, 747, 52/741, 510, 511, 512, 513; 110/336

[56] References Cited

U.S. PATENT DOCUMENTS

| | | | |
|---|---|---|---|
| 1,951,421 | 3/1934 | Kleitz | 52/513 |
| 2,536,039 | 1/1951 | Craven | 52/513 |
| 2,889,698 | 6/1959 | Stevens | 52/513 |
| 4,074,493 | 2/1978 | Outram | 52/741 X |
| 4,215,519 | 8/1980 | Koch | 52/741 |
| 4,425,745 | 1/1984 | Grätz et al. | 52/512 |
| 4,698,948 | 10/1987 | Yamashita et al. | 52/612 X |
| 4,811,537 | 3/1989 | D'Epenoux | 52/511 X |
| 4,932,187 | 6/1990 | Kraemer et al. | 52/747 |

FOREIGN PATENT DOCUMENTS

| | | | |
|---|---|---|---|
| 1002477 | 3/1983 | U.S.S.R. | 52/747 |

*Primary Examiner*—David A. Scherbel
*Assistant Examiner*—Kien Nguyen
*Attorney, Agent, or Firm*—Norman E. Lehrer; Franklyn Schoenberg

[57] ABSTRACT

A method is provided for lining furnace walls with cement-like monolithic insulation linings wherein a plurality of wire hanger devices are welded to the furnace wall to be insulated in a predetermined spaced array with each of said studs having a free end projecting outwardly from the furnace wall;

mounting a plurality of elongated stud extender members having a radial stop flange mounted thereon on the free ends of a portion of the end welded studs secured to the furnace wall with the free ends thereof projecting perpendicularly from the furnace wall and the radial stop flange disposed so as to provide a bearing surface with a substantially uniform level of spacing from the end mounted on the furnace wall;

attaching a planar panel over a plurality of the elongated extender members projecting from the furnace wall and supporting the same on the extender members with the panel bearing on the radial stop flanges mounted on the stud extender members spaced from and substantially parallel to the furnace wall to be insulated, wherein a generally continuous space is defined therebetween;

feeding a cement-like insulation material in the continuous space between the supported planar panel and the furnace wall until the space therebetween is substantially filled with insulation material;

removing the panel from the elongated extender members when the cement-like insulation material is set sufficiently to be substantially self-supporting.

11 Claims, 4 Drawing Sheets

METHOD FOR CONSTRUCTION OF REFRACTORY LINING FOR FURNACE

FIELD OF THE INVENTION

The present invention relates to insulation material for a structure such as refractory walls of a furnace and, more particularly, to improved methods for construction of insulated refractory walls of a furnace and the like.

BACKGROUND OF THE INVENTION

For many years heat treating furnaces, refractory furnaces, ceramic kilns, brick kilns, and the like, were lined with thick dense refractory brick or blocks, and more recently, many of such furnaces are lined with cement-like materials such as gunite to protect the walls from extreme heat within the furnace. In constructing a cement-like insulation lining for the furnace wall, it is a common practice to spray coat a desired thickness of cement-like material thereon to form a substantially monolithic insulation lining with a plurality of spaced devices such as wire hangers mounted on metal studs welded to the furnace wall being employed for anchoring the insulation lining. Typically, the wire hangers employed as anchors are in the form of elongated lengths of wire mounted at a central point on welded studs with the opposite free ends thereof projecting inwardly from the furnace wall. The wire hangers are secured to the studs by nuts or the like which engage the free end, generally threaded, of the studs. During the course of time, it is also necessary to remove the old insulation material and replace the hangers before relining the furnace as they will deteriorate during use.

The spray application method of insulating refractory furnace walls involves considerable skill, labor and time to achieve an insulation lining with a substantially uniform thickness and surface which is securely anchored. It is generally required to individually position and weld the wire hanger studs to the surface of the wall to be protected and to secure the elongated wire hangers to the studs, the arrangement of wire hanger devices being important to insure that the entire furnace wall surface is protected. Thus, even through conventional welding techniques may be employed, the arrangement and placement of wire hangers involves considerable time and labor in new installations or in relining a furnace.

Spray application of cement-like insulation to the refractory furnace wall involves considerable skill and time to achieve the desired thickness and surface condition of the coating. Moreover, the process can be hazardous to the personnel involved in the operation, as well as being wasteful as to the insulation materials, since considerable quantities thereof may drop from the wall and accumulate on the floor. Needless to say, the furnace must be shut down and is out of operation during the extended periods of time needed to effect the insulation installation or replacement.

SUMMARY OF THE INVENTION

It is accordingly an object of the present invention to provide a method for lining the wall of a refractory furnace and the like with a substantially monolithic refractory insulation which is efficient and substantially non-hazardous including a relatively simple, effective method for applying a cement-like insulation lining material such as gunite to the wall of the furnace.

It is another object of the present invention to provide a method for construction of substantially monolithic insulation linings for the surface of refractory furnace walls which is capable of efficiently installing a cement-like monolithic insulation lining of substantially uniform thickness and surface to a refractory furnace wall without spray application of the insulation material, is substantially non-hazardous to the health of personnel involved in its construction and will reduce the time that the furnace is out of operation.

It is a further object of the present invention to provide a method which facilitates construction of cement-like insulation linings for furnace walls having a substantially uniform thickness and surface by providing a continuous space adjacent the furnace wall and an efficient method for feeding a cement-like insulation material into the continuous space which substantially reduces the amount of insulation material wasted and possible hazards to the health of personnel during the construction thereof as well as the time a furnace is out of operation.

It is still a further object of the present invention to provide a method which facilitates construction of a cement-like monolithic insulation lining for refractory furnace walls without the need for spray application of the insulation lining material by providing a method of forming a continuous space adjacent the furnace wall which is adaptable for fabrication of linings of desired thickness, will inhibit the loss of material during application to furnace walls, will reduce the hazards to personnel involved with the construction of the furnace lining and will reduce the time that the furnace is out of operation.

In accordance with the present invention there is provided a method for lining furnace walls with cement-like monolithic insulation linings which comprises:

(a) providing a plurality of end weldable metal studs and anchoring by welding at one end each of said studs to a furnace wall to be insulated in a predetermined spaced array with each of said studs having a free end projecting outwardly from the furnace wall;

(b) providing a plurality of elongated wire hangers and securing said wire hangers about each of the end welded metal studs;

(c) providing a plurality of elongated stud extender members having an end adapted to be mounted on the free end of said end welded studs and an opposite free end, each of said stud extender members having a radial stop flange mounted thereon intermediate the ends thereof, and mounting said elongated stud extender members at predetermined spaced intervals to said furnace wall by mounting the same on the free ends of a portion of said end welded studs secured to the furnace wall with the free ends of said elongated extender member projecting substantially perpendicularly from the furnace wall and the radial stop flanges disposed so as to provide a bearing surface with a substantially uniform level of spacing from the end mounted on the furnace wall;

(d) providing at least one thin planar panel of a substantially rigid material of a size sufficient to substantially overlie the surface of the furnace wall to be insulated in a spaced substantially parallel relationship wherein a generally continuous space is defined therebetween and attaching said planar panel of material to said furnace wall by impaling the same on a plurality of the free ends of elongated extender members projecting from said furnace wall;

(e) supporting said planar panel on said elongated extender members with said panel bearing on the bearing surface of substantially each of the radial stop flanges mounted on said stud extender members with said panel disposed spaced from and substantially parallel to the furnace wall to be insulated, wherein a generally continuous space is defined therebetween;

(f) feeding a cement-like insulation material in the substantially continuous space between said supported planar panel and said furnace wall until the space therebetween is substantially filled with said insulation material;

(g) removing said panel from said from said elongated extender members when said cement-like material is set sufficiently to be substantially self-supporting, wherein a substantially monolithic insulation lining for said furnace wall is constructed.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one embodiment which is presently preferred; it being understood that the invention is not intended to be limited to the precise arrangements and instrumentalities shown.

DETAILED DESCRIPTION OF THE PREFERRED EMBODIMENT

The invention is concerned with an efficient and safe way of constructing and anchoring cement-like substantially monolithic insulation linings on the wall of a furnace which includes an effective means for applying insulation materials to the wall of a furnace which are conventionally applied by spraying.

Figure 1:
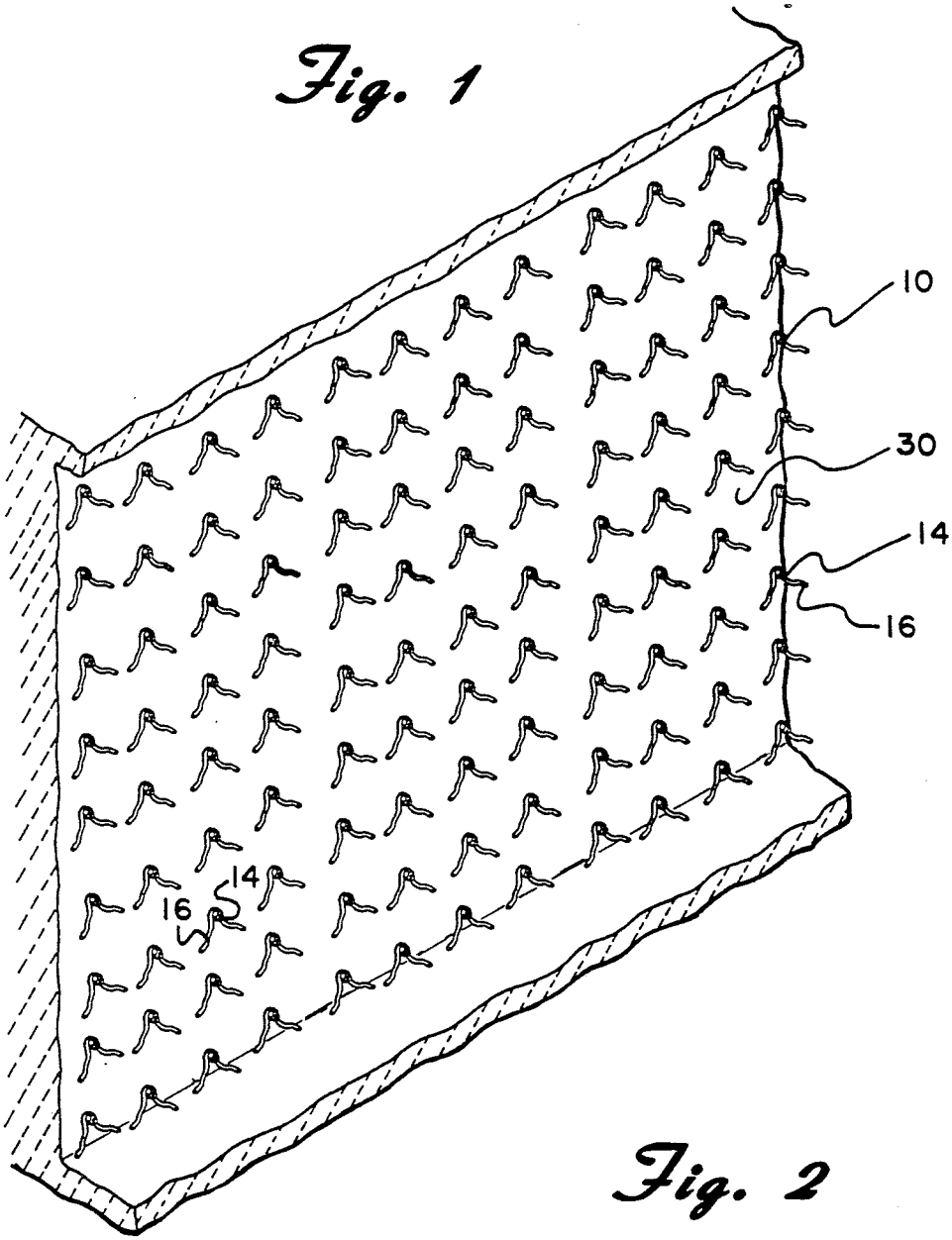
FIG. 1 is a perspective view, part in section and part broken away, of the wall of a furnace to be insulated with an array of a plurality of spaced elongated wire hangers mounted thereon.
Figure 2:
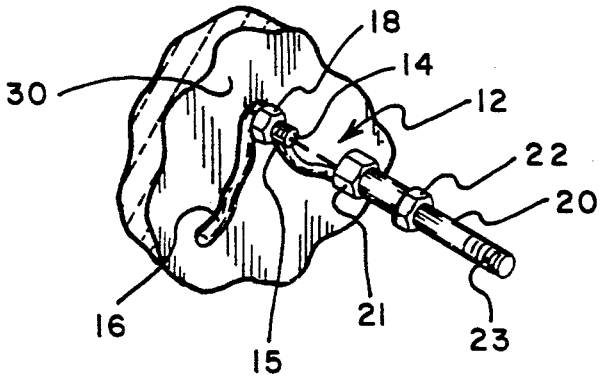
FIG. 2 is an enlarged exploded view in perspective of a wire hanger extender assembly in accordance with the invention.
Figure 3:
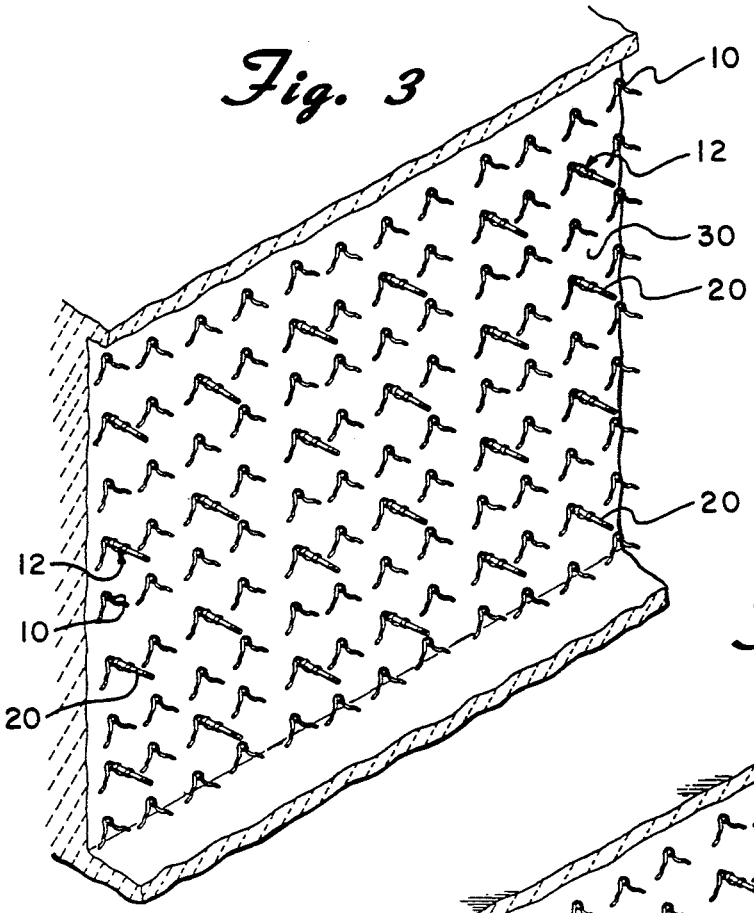
FIG. 3 is a perspective view, part in section and part broken away, of the wall of a furnace to be insulated in accordance with the practice of the invention with a plurality of wire hanger extender assemblies mounted thereon at predetermined spaced intervals.
Figure 4:
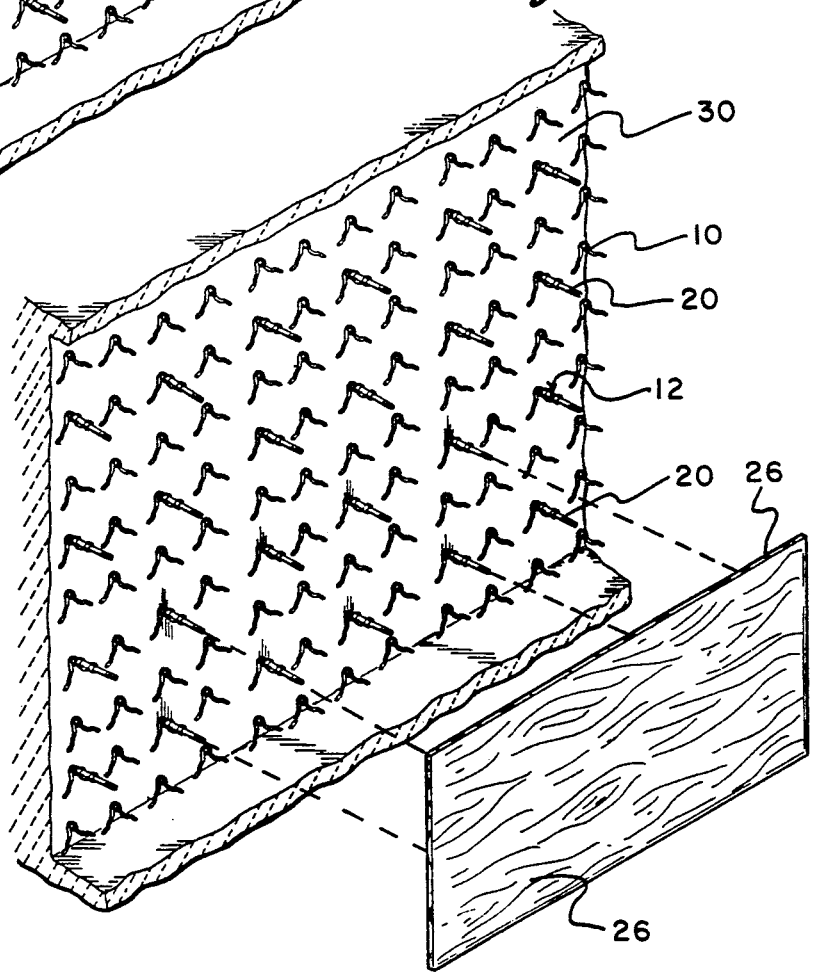
FIG. 4 is an exploded perspective view, part in section and part broken away, illustrating the step of attaching a planar panel of plywood to the furnace wall of FIG. 3 in accordance with the practice of the invention.

Referring now to the drawings, where like reference numerals identify like parts, there is shown in FIGS. 1 to 3 the wall of the structure to be lined with insulation, i.e. the metallic wall 30 of a furnace. In FIG. 1 is shown a furnace wall 30 with an array of wire hangers 10 affixed thereto by spot welding or the like which are typical of the wire hanger devices conventionally employed as anchors for insulation lining applied to the furnace wall 30. In FIG. 3 is illustrated a furnace wall 30 wherein a plurality of wire hanger extender assemblies 12 are affixed at generally uniformly spaced intervals to the furnace wall 30 in accordance with the practice of the invention in addition to an array of the wire hanger devices 10 also affixed to the furnace wall 30.

The wire hangers 10 include a plurality of end weldable metal studs 14, typically about 1 to 2 inches long, which are welded at one end to the metal furnace wall 30 by conventional end welding technique. The studs 14 are anchored to the furnace wall 30 in a predetermined spaced, aligned array, generally at about 10 inch intervals. The free ends 15 of the studs 14 projecting from the furnace wall 30 are threaded. An elongate length of metal wire 16, e.g. about 3 to 6 inches long, is centrally mounted on and secured to each of the metal studs 14 by a nut 18 or the like with the opposite free ends thereof projecting outwardly from the wall of the furnace 30.

The wire hanger extender assembly 12 of the invention shown in FIG. 2 includes the metal stud 14 and elongate length of wire 16 components of the wire hanger 10 together with an elongated stud extender member 20. The stud extender members 20 have an end 21 which is adapted to be mounted on the free threaded end of the welded metal studs 14, such as an internally threaded sleeve, an opposite end 23 which is generally threaded and a radial stop flange 22 or the like stand off which is mounted on the extender member 20 intermediate the ends 21, 23. The radial stop flanges 22 of the wire hanger assemblies 12 are adapted to provide a bearing surface which is of a generally uniform level of spacing from the end secured to the furnace wall 21. The radial stop flanges may be adjustable for varying the bearing or supporting flange surface or may be secured to the extender member 20 to provide only one spacing means. The length of the stud extender members 20 can vary depending on the thickness of insulation to be constructed on the furnace wall and, in general, may be from about 3 to 6 inches long.

As indicated, FIG. 3 shows the wall of the furnace to be lined with insulation in accordance with the practice of the invention. The wall 30 has a plurality of wire hangers 10 affixed thereto by welding or the like in a spaced generally predetermined aligned array with a plurality of wire hanger extender assemblies 12 also affixed to the wall by welding or the like at predetermined uniformly spaced intervals, generally at about 20 inch spacing. The wire hanger extender assemblies 12 are affixed to the wall 30 with the elongated extender members 20 projecting substantially perpendicularly from the wall 30 in generally vertical alignment with the free end thereof 23 being threaded.

Figure 5:
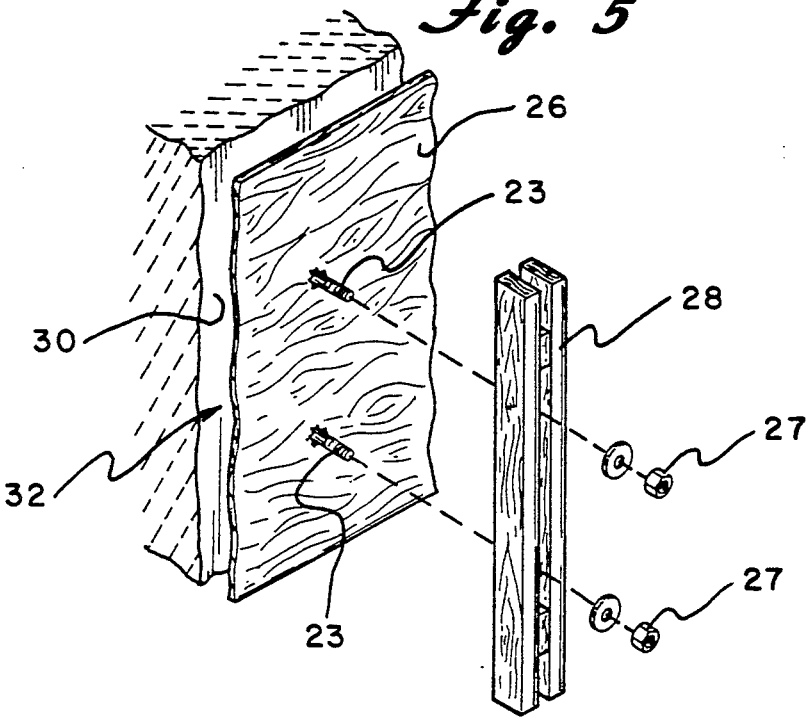
FIG. 5 is a fragmentary exploded view in perspective of the furnace wall of FIG. 4 illustrating the step of supporting a planar panel of plywood on the wire hanger extender assemblies mounted on the wall of a furnace.

Referring now to FIGS. 3 to 8, there is shown the steps in accordance with the practice of the invention of applying a concrete-like insulation to the furnace wall to be insulated. Once the wire hangers 10 and wire hanger extender assemblies 12 have been affixed to the wall of the furnace 30, an appropriate form structure is required to construct an insulation lining for the furnace wall. In accordance with the invention, a thin planar panel 26 of a substantially rigid material such as plywood is provided for such purpose, the thin planar panel being mounted on the furnace wall in a spaced, substantially parallel relationship thereto to form a substantially continuous space therebetween. This panel 26 is attached to the wall 30 by impaling the panel onto the free ends 23 of a plurality of the elongated stud extender members 20 which project from the wall of the furnace. FIG. 5 shows the planar panel 26 at this stage. The impaled panel 26 is then secured to the extender members 20 by elongated rigid support members 28 with the surface of the panel 26 facing the furnace wall 30 bearing on the radial stop flanges 22 of the wire hanger assemblies 12 which are, as indicated, of a generally uniform level of spacing from the end secured to the furnace wall 30. A substantially continuous space 32 is thereby defined between the furnace wall 30 and supported panel.

The planar panels 26 suitable for use in accordance with the practice of the invention may be any thin, substantially rigid material such as wood, plywood, plastic or the like which is substantially self-supporting yet thin enough to be readily impaled on the extender members 20, e.g. about $\frac{1}{8}$ to $\frac{3}{8}$ inches. In general, the panels 26 are of a size that can be manually handled, e.g. 4 feet by 8 feet sheets, and of a generally rectangular shape with substantially linear top, bottom and side edges.

Figure 6:
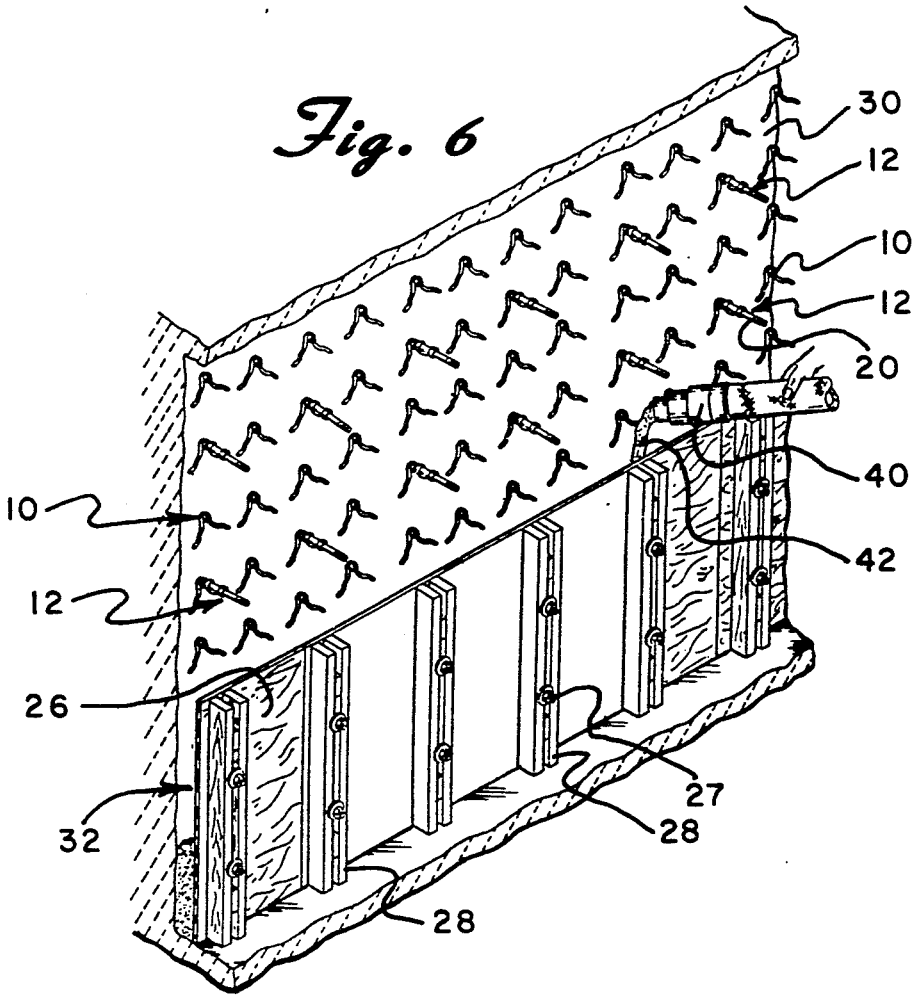
FIG. 6 is a perspective view, part in section and part broken away, illustrating the step of feeding cement-like insulation material to the furnace wall of FIG. 4 on which a first planar panel is supported in readiness for application of insulation material.

The elongated rigid support members 28 made of wood or the like are substantially the same length as the width of the panel 26, e.g. about 4 feet, and are adapted to be vertically positioned on the generally aligned projecting ends of a plurality of the extender members 20 by virtue of slots, spaced holes or the like formed therethrough. The support members 28 are then secured in place by nuts 27 which engage the threaded ends of the extender members 23. As shown in FIG. 6, a plurality of such support members 28 are secured in place in substantially parallel vertical alignment over the face of the panel 26 overlying the furnace wall to be insulated, generally at about 20 inch intervals.

In order to construct an insulation lining on a furnace wall, one or more panels 26 may be secured to the wire hanger assemblies 12 in a substantially continuous course along the furnace wall 30 which extends between the furnace walls laterally extending from the furnace wall 30 to be insulated, in general, with the bottom edge of the course of panels 26 bearing on the furnace floor 31. The continuous space 32 thereby being provided between the furnace wall 30 and the supported panel 26 "form structure" is of a generally predetermined thickness within which a sufficient quantity of insulation material may be fed for the desired insulating effect. In order to construct the insulation lining, the panels 26 secured to the wire hanger extender assemblies 12 in a first course will abut the laterally extending furnace walls and the bottom edge will bear on the furnace floor. Consequently, the continuous space 32 is bounded on three sides so that insulation material can be retained within the space 32 until it sets sufficiently to be self-supporting. It would be evident that other conventional means may also be used, if desired for particular applications, to retain insulation material within the continuous space 32 between the furnace wall 20 and supported panel 26 form structure.

After the form structure has been constructed, the open top end thereby created provides access to the enclosed continuous space 32, and insulation material 42 in slurry or other flowable form can be fed into the continuous space 32 by conventional injection feed means such as a hose 40 connected to a source of cement-like material (not shown). The continuous space 32 is substantially completely filled with insulation material 42, preferably to about two inches from the top edge of the panel, the air being readily displaced as the insulation material is injected into the space 32. The insulation material suitable for use will be generally the same as the cement-like material such as gunite which is conventionally applied to the furnace wall by spraying. The supported planar panel will be substantially rigid enough to support the amount of insulation material used to fill the space and the means used to secure the wire hanger extender assemblies 12 to the furnace wall will be strong enough to withstand the weight of insulation material used. In general, the thickness of insulation material applied to the furnace wall may vary depending on the desired insulation effect, e.g. about 3 to 5 inches. When an adequate amount of insulation material has been injected into the continuous space, the cement-like material will gradually set to a self-supporting structure in a conventional manner without the application of heat or other modification.

Figure 7:
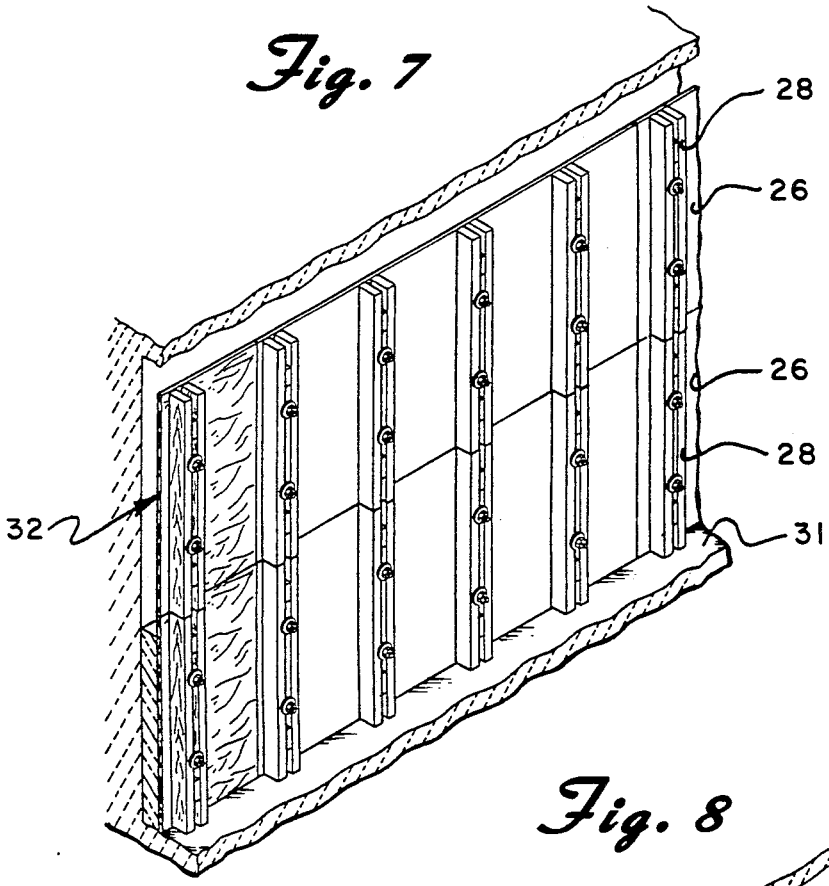
FIG. 7 is a perspective view, part in section and part broken away, illustrating the furnace wall shown in FIG. 6 with a second planar panel of plywood supported thereon in readiness for application of an insulation material.
Figure 8:
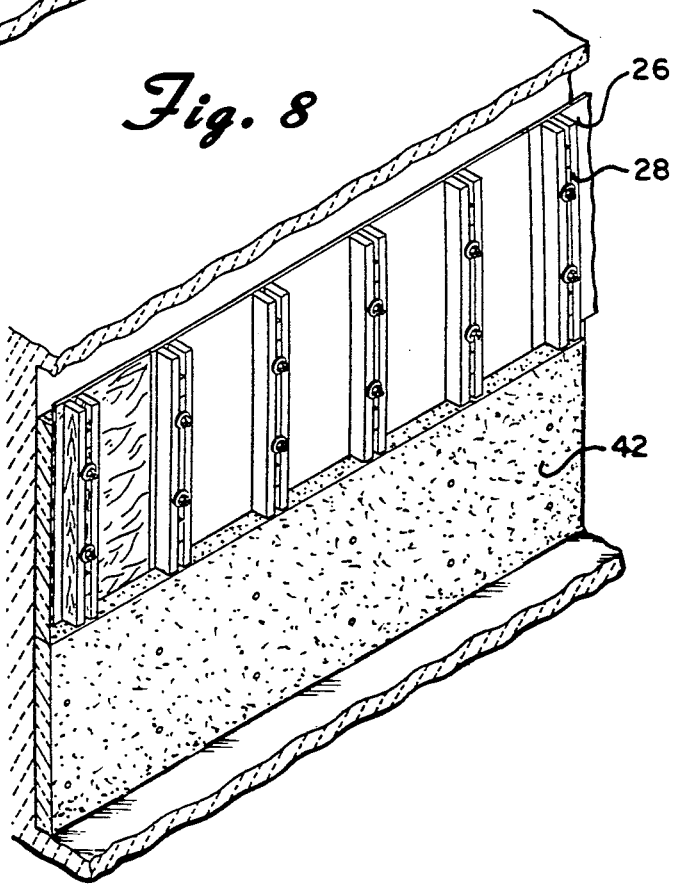
FIG. 8 is a perspective view, part in section and part broken away, illustrating the furnace wall shown in FIG. 7 with the first planar panel of plywood removed therefrom after insulation material has been applied to the surface of the furnace wall.

In the embodiment shown in FIGS. 4 to 8, a second course of panels is employed to provide the supported panel form structure which substantially covers the furnace wall 30 with insulation material 42. As shown in FIG. 7, a second course of panels 26 are supported on the wire hanger extender assembles 12 secured to the furnace wall 30. In this case, the second course of panels are disposed contiguous with the top edge of the first course of panel. Preferably, the bottom edge of the second course of panels will bear on the top edge of the insulation material 42 applied to the furnace wall in the continuous space 32 provided by the first course of panels along the inner surface of the top edge of the first course of panels. The continuous space 32 formed between the furnace wall 30 and second course of panels 26 is thus bounded on three sides for retaining insulation material to be applied to the surface of the furnace wall by filling the continuous space 32.

When the cement-like insulation material used to fill the space between the furnace wall and the supported panels have set to a strength where it will be self-supporting, the planar panels may be removed from the surface of the furnace and the furnace wall will thus have been provided with a substantially monolithic insulation lining of suitable thickness and surface to achieve the desired insulation characteristics.

From the foregoing it should be readily apparent to those skilled in the art that the present invention provides an efficient and safe method of insulating the walls of a refractory furnace which can be dependably carried without inadvertent loss of insulation material and without the need for manual spray application of the insulation material and undue hazards to the health of the personnel involved in the operation.

Having thus described the invention in relation to the drawings hereof, it will be clear that modifications could be made in the preferred embodiment without departing from the spirit of the invention. Accordingly, it is not intended that the words used to describe the invention be limiting thereof nor should the drawings be considered so. It is intended that the invention be limited only by the scope of the appended claims.

What is claimed is:

1. A method for lining furnace walls with cement-like monolithic insulation linings which comprises:

(a) providing a plurality of end weldable metal studs and anchoring by welding at one end each of said studs to a furnace wall to be insulated in a predetermined spaced array with each of said studs having a free end projecting outwardly from the furnace wall;

(b) providing a plurality of elongated wire hangers and securing said wire hangers at a central point thereof about each of the end welded metal studs with the opposite free ends thereof projecting inwardly from the furnace wall;

(c) providing a plurality of elongated stud extender members having an end adapted to be mounted on the free end of said end welded studs and an opposite free end, each of said stud extender members having a radial stop flange mounted thereon intermediate the ends thereof, and mounting said elongated stud extender members in a predetermined spaced array to said furnace wall by mounting the same on the free ends of a portion of said end welded studs secured to the furnace wall with said elongated extender members projecting substantially perpendicularly from the furnace wall and with the radial stop flanges mounted thereon disposed so as to provide a bearing surface with a substantially uniform level of spacing from the end mounted on the furnace wall;

(d) providing at least one thin planar panel member of a substantially rigid material and a size sufficient to substantially overlie at least a portion the surface of the furnace wall to be insulated, attaching said planar panel member to said furnace wall by impaling the same on a plurality of the free ends of elongated extender members projecting from said portion of furnace wall to be insulated with the free ends of said extender members projecting through said panel member and supporting said planar panel member on said elongated extender members with said panel member bearing on the bearing surface of substantially each of the radial stop flanges mounted on said plurality of stud extender members with said panel member disposed spaced from and substantially parallel to the furnace wall to be insulated, wherein a generally continuous space is defined therebetween;

(e) feeding a cement-like insulation material in the substantially continuous space between said supported planar panel member and said furnace wall until the space therebetween is substantially filled with said insulation material; and (f) removing said panel member from said elongated extender members when said cement-like material is set sufficiently to be substantially self-supporting, wherein a substantially monolithic insulation lining for said furnace wall is constructed.

2. The method for lining furnace walls as claimed in claim 1, wherein said planar panel member is supported on the plurality of elongated extender members by support means comprising elongated support members vertically positioned over said panel member and secured to the free ends of a vertical array of the extender members projecting through said panel member.

3. The method for lining furnace walls as claimed in claim 2, wherein a plurality of said support means are positioned on the surface of said planar panel in spaced substantially parallel relationship and said support members are secured to the end of the extender members projecting through the planar panel member.

4. The method for lining furnace walls as claimed in claim 2, wherein said elongated support members are made from wood of a length which vertically extends substantially between top and bottom edges of said planar panel member.

5. The method for lining furnace walls as claimed in claim 1, wherein said planar panel member is a sheet of plywood.

6. The method for lining furnace walls as claimed in claim 1, wherein the free end of said elongated stud extender members is threaded.

7. The method for lining furnace walls as claimed in claim 1, wherein said cement-like insulation material is gunite.

8. The method for lining furnace walls as claimed in claim 1, wherein said furnace wall to be lined is a metal furnace wall.

9. A method for constructing refractory furnace walls with cement-like monolithic insulation linings which comprises:

(a) providing a plurality of end weldable metal studs and anchoring by welding at one end each of said studs to a furnace wall to be insulated in a predetermined spaced array, each of said studs having a threaded free end;

(b) providing a plurality of elongated wire hangers and securing said wire hangers about each of the end welded metal studs with opposite free ends thereof projecting inwardly from the furnace wall;

(c) providing a plurality of elongated stud extender members having an end adapted to be mounted on the free end of said end welded studs and an opposite free end, each of said stud extender members having a radial stop flange mounted thereon intermediate the ends thereof, and mounting said elongated stud extender members at predetermined spaced intervals to said furnace wall by mounting the same on the a portion of the free ends of said end welded studs secured to the furnace wall;

(d) providing at least one thin planar panel member of a substantially rigid material having substantially linear parallel top and bottom edges and opposite parallel side edges extending therebetween, said planar panel being of a size sufficient to substantially overlie the surface of the furnace wall to be insulated and attaching said planar panel of material to said furnace wall by impaling the same on a plurality of the elongated extender members projecting from said furnace wall with said planar panel member bearing on each of the radial stop flanges mounted on the stud extension members in a spaced substantially parallel relationship to the furnace wall and with the free ends of said extension members projecting from said panel member;

(e) supporting said planar panel member on said elongated extender members bearing on the radial stop flanges spaced substantially parallel to the furnace wall to be insulated;

(f) repeating steps (d) and (e) with other of said planar panel members of substantially rigid material until a first course of said planar panel members extending between furnace walls laterally extending from the wall to be insulated with the bottom edges of said planar panel members bearing on the floor of the furnace, wherein a substantially continuous space is defined between the furnace wall to be insulated and the planar panel members supported on the stud extender members mounted on the ends of end welded wire hanger studs;

(g) feeding a cement-like insulation material in the substantially continuous space between said supported planar panel members and said furnace wall until the space therebetween is substantially filled with said insulation material to about the top edges of said planar panel members, wherein a first course of insulation lining material is applied to a furnace wall to be insulated;

(h) repeating steps (d), (e) and (f) with additional of said planar panel members of rigid material until a second course of said panel members extends between the furnace walls laterally extending from the wall to be insulated with the bottom edge of said additional panels bearing on the top of the first course of insulation material lining the wall of the furnace and being disposed substantially contiguous with the top edge of the first course of supported panel members, wherein a substantially continuous space is defined between the furnace wall to be insulated and the additional planar panel members supported on the stud extender members mounted on the ends of the end welded wire hanger studs;

(i) repeating step (g), wherein a second course of insulation material is applied to the furnace wall;

(j) repeating steps (h) and (i) until cement-like insulation material is applied to the surface of a furnace wall to provide a substantially monolithic lining of cement-like insulation material over substantially the entire surface of the furnace wall to be insulated; and (k) removing the planar panel members from the elongated extender members when said cement-like material is set sufficiently to be substantially self-supporting.

10. The method for constructing refractory furnace walls as claimed in claim 9, wherein said cement-like insulation material is gunite.

11. The method of constructing refractory walls as claimed in claim 9, wherein said thin planar member is a sheet of plywood.

* * * * *